US011312532B2

(12) United States Patent
Abjean et al.

(10) Patent No.: US 11,312,532 B2
(45) Date of Patent: Apr. 26, 2022

(54) SHELF-READY PACKAGING AND METHODS FOR TRANSPORTING AND DISPLAYING FOOD PRODUCTS

(71) Applicant: Chobani LLC, Norwich, NY (US)

(72) Inventors: Marc Abjean, Twin Falls, ID (US); Jean-Yves Latour, Utica, NY (US); Robert Jason Clark, Jr., Kimberly, ID (US)

(73) Assignee: Chobani LLC, Norwich, NY (US)

( * ) Notice: Subject to any disclaimer, the term of this patent is extended or adjusted under 35 U.S.C. 154(b) by 0 days.

(21) Appl. No.: 16/841,016

(22) Filed: Apr. 6, 2020

(65) Prior Publication Data

US 2021/0309412 A1 Oct. 7, 2021

(51) Int. Cl.

| | |
|---|---|
| ***B65D 5/42*** | (2006.01) |
| ***B65D 5/68*** | (2006.01) |
| ***B65D 5/54*** | (2006.01) |
| *B31B 50/26* | (2017.01) |

(52) U.S. Cl.

CPC ..... *B65D 5/68* (2013.01); *B65D 5/4295* (2013.01); *B65D 5/5475* (2013.01); *B31B 50/26* (2017.08); *B65D 5/4266* (2013.01)

(58) Field of Classification Search

CPC ..... B65D 5/0005; B65D 5/4295; B65D 5/54; B65D 5/5405; B65D 5/5445; B65D 5/5475; B65D 5/16; B31B 50/26

USPC ..... 229/101, 101.1, 120, 120.11, 122, 122.1, 229/164, 240, 242, 103, 235; 206/774, 206/746, 736

See application file for complete search history.

(56) References Cited

U.S. PATENT DOCUMENTS

| | | | | |
|---|---|---|---|---|
| 3,028,952 A * | 4/1962 | Milio | ..... | A22C 13/023 206/446 |
| 3,519,123 A | 7/1970 | Nagle et al. | | |
| 3,756,502 A | 9/1973 | Swanson et al. | | |
| 3,858,717 A | 1/1975 | Peters | | |

(Continued)

FOREIGN PATENT DOCUMENTS

WO WO-9831593 A1 * 7/1998 ..... B65D 5/5253

OTHER PUBLICATIONS

Rena Sherwood, How to Face and Front, Sep. 4, 2019, webpage (Year: 2019).*

*Primary Examiner* — Nathan J Newhouse
*Assistant Examiner* — Phillip D Schmidt
(74) *Attorney, Agent, or Firm* — Wood Herron & Evans LLP

(57) ABSTRACT

A shelf-ready packaging (SRP) and method for transporting and displaying food products are provided, the SRP configured to be efficient in transporting a high number of the food products while also still being able to fit on a retail store shelf. To this end, the SRP includes a cover element and a base tray including first and second tray portions connected along a single tear line. To convert the SRP from a first transport configuration to a second display configuration, the cover element is lifted off the base tray and the first and second tray portions are separated along the tear line, which thereby changes the overall length of the SRP such that it can fit on the standard retail store shelf. The SRP provides a clean, uniform appearance when in the second display configuration while providing maximum visibility and access to the food products stored therein.

7 Claims, 8 Drawing Sheets

(56) References Cited

U.S. PATENT DOCUMENTS

| | | | | |
|---|---|---|---|---|
| 4,848,651 | A * | 7/1989 | Hartness | B65D 5/5495 229/125.33 |
| 6,719,143 | B2 | 4/2004 | Rice | |
| 8,028,839 | B2 * | 10/2011 | Learn | B65D 5/504 206/774 |
| 8,096,435 | B2 | 1/2012 | Auclair et al. | |
| D699,101 | S | 2/2014 | Strom et al. | |
| D706,128 | S | 6/2014 | Strom et al. | |
| 8,939,290 | B2 | 1/2015 | DeCello et al. | |
| 9,187,207 | B2 | 11/2015 | Gessler, Jr. et al. | |
| 9,266,632 | B1 * | 2/2016 | Anderson | B65B 5/026 |
| 9,440,764 | B2 | 9/2016 | DeCello et al. | |
| 9,555,919 | B2 | 1/2017 | Gessler, Jr. et al. | |
| D787,324 | S | 5/2017 | Sotka | |
| 9,809,349 | B2 | 11/2017 | Gessler, Jr. et al. | |
| 2018/0065744 | A1 | 3/2018 | Park | |
| 2019/0185201 | A1 | 6/2019 | Mccarthy | |
| 2019/0248539 | A1 | 8/2019 | Suokas | |
| 2019/0322412 | A1 | 10/2019 | Couture et al. | |
| 2020/0223581 | A1 * | 7/2020 | Lohoff | B65D 5/542 |
| 2020/0307852 | A1 * | 10/2020 | Simpkins | B65D 5/4266 |

* cited by examiner

SHELF-READY PACKAGING AND METHODS FOR TRANSPORTING AND DISPLAYING FOOD PRODUCTS

TECHNICAL FIELD

The present invention generally relates to product packaging, and more specifically, relates to shipping and display containers for food products and their associated methods of use.

BACKGROUND

Shelf-ready packaging (also referred to as SRP) is a growing portion of the packaging industry for various types of consumer products. The purpose of shelf-ready packaging is to store and protect product both during transportation and during display on a store shelf. The shelf-ready packaging may typically be converted between first and second configurations designed for transportation and display, respectively. One overall goal in the packaging industry is to make such packaging easy to use but also reliable for the end goals of protecting the products during shipping and displaying the products in a desirable manner when the packaging is placed on a store shelf for consumers.

To this end, several conventional packaging designs have been developed for such a convertible SRP. For example, U.S. Pat. Nos. 9,440,764 and 10,421,580 show convertible box-like packagings that move between shipping and display configurations. The products within these packaging are understood to remain in the same position in both configurations, e.g., the display configuration is defined simply by a removal of what is typically a top portion of the packaging, so as to reveal the products contained therein. Another example of a conventional shelf-ready packaging is shown in U.S. Pat. No. 10,131,462.

Such types of known SRP designs are used with varying types of consumer products sold in the retail setting. In some environments, such as food retail, the competition for product space is significant and additional space constraints may be placed on product manufacturers by the stores having display shelves of a certain length or size. This constraint is particularly true for food products that must be stored and displayed in a refrigerated setting, e.g., for dairy products and the like. As a result, known SRP designs have not been adopted as much as possible within the food product packaging industry.

Therefore, further improvements are desired in this field of SRP. To this end, it would be desirable to provide a shelf-ready packaging that maximizes storage capacity for shipping while also being tailored for display use in retail settings where space constraints and limits are present.

SUMMARY

In accordance with embodiments of the present invention, a shelf-ready packaging is provided for transporting and displaying food products. The packaging includes a cover element and a base tray. The base tray has first and second tray portions connected to one another and defining a storage space for the food products. The base tray defines an open top that is covered when the cover element engages the base tray in a first transport configuration of the packaging. The first tray portion is removable from the second tray portion such that the packaging is converted from the first transport configuration to a second display configuration by lifting the cover element from the base tray and removing the first tray portion from the second tray portion. The packaging defines a first length when in the first transport configuration and a second length shorter than the first length when in the second display configuration. This arrangement of the configurations advantageously allows for maximizing storage capacity for food products during shipping while still allowing for the shelf-ready packaging to be sized to fit on standard retail shelves used in stores.

In one embodiment, the first length is sized such that the packaging stores a plurality of rows of the food product when in the first transport configuration. At least one of the plurality of rows of the food product sits directly upon the first tray portion when in the first transport configuration. The second length is sized such that only a partial portion of the plurality of rows of the food product can sit directly upon the second tray portion when in the second display configuration. To this end, the packaging requires some movement of the at least one row of food products when converting between the configurations, which can result in an advantageous/desirable initial display of more of the products in the second display configuration.

In another embodiment, the second length is at least 50% of the first length. This allows for a majority of the food product to be supported by the second tray portion in both configurations.

In a further embodiment, the cover element and the base tray collectively define a rectangular box shape when in the first transport configuration, the rectangular box shape having top and bottom surfaces, opposing side surfaces, and opposing front and rear end surfaces. The base tray in the second display configuration is open along the top surface and the front end surface to provide access and visibility to the food products. In this regard, the second display configuration provides convenient visibility and access into the storage space so that the food products can be reviewed and removed for purchase by consumers.

In yet another embodiment, the base tray includes a tear line extending between the first and second tray portions. This tear line renders the first tray portion removable from the second tray portion by separating along the tear line.

In one embodiment, the base tray includes only one tear line. As such, separation of the first and second tray portions is performed with just one tear action by an operator. This feature enables rapid reconfiguration between the first transport configuration and the second display configuration, which is easy for retail personnel such as restocking clerks to accomplish.

In another embodiment, the base tray includes a bottom wall, two side walls extending from the bottom wall, and two end walls extending from the bottom wall and between the two side walls. The tear line extends across the bottom wall and the two side walls in such an embodiment. More specifically, the tear line may be oriented generally parallel to the two end walls at the bottom wall, and then angled along each of the two side walls so as to be oriented non-parallel to the two end walls along each of the two side walls. Such a configuration of the tear line beneficially forms an open front of the packaging for visibility of the food products therein when in the second display configuration.

In yet another embodiment, the packaging includes a plurality of vent apertures formed in the cover element and in the base tray. The tear line extends across at least one of the vent apertures. This positioning of the tear line limits the amount of tearing action required to separate the first and second tray portions.

In a further embodiment, the tear line is configured to produce a smooth-edge break between the first and second tray portions such that the second tray portion presents a smooth front edge when the packaging is displayed in the second display configuration.

In another embodiment, the base tray is formed from a generally planar tray blank having several panel portions connected by linear fold lines and/or the tear line. For example, the base tray is made out of a cardboard material with such features in the blank. Such a formation from a blank enables easy manufacturing of the shelf-ready packaging, and quick assembly with known packaging equipment.

According to other embodiments of the invention, a method is provided for transporting and displaying a food product. The method includes transporting a shelf-ready packaging containing the food product to a retail store shelf where the food product is to be displayed. The packaging remains in a first transport configuration during the transporting. The packaging includes a base tray with first and second tray portions removably connected to each other and a cover element that covers an open top defined by the base tray in the first transport configuration. The method further includes converting the packaging to a second display configuration, specifically by lifting the cover element from the base tray, and removing the first tray portion from the second tray portion to reveal the food products within the packaging. The packaging defines a first length when in the first transport configuration and defines a second length less than the first length when in the second display configuration. The method allows for maximized storage space during transport and a desirable display of product that still fits on a standard retail store shelf following the reconfiguration of the packaging.

In one embodiment, the step of converting the packaging to the second display configuration further includes after lifting the cover element from the base tray, moving at least one of the plurality of rows of the food product within the base tray to sit on top of other ones of the plurality of rows of the food product, and such that none of the rows of food product sit directly upon the first tray portion following this step. The first tray portion may then be removed from the second tray portion after movement of the at least one of the plurality of rows of the food product.

In another embodiment, the at least one of the plurality of rows of the food product are moved to sit on top of other rows of the food product located closest to a front end of the packaging to position those food products in a readily-accessible position for retrieval by consumers when the food product is displayed on a retail store shelf with the packaging in the second display configuration. For example, in embodiments where only one row of the food product sits directly on the first tray portion when in the first transport configuration, this one row of the food product is moved on top of the frontmost row of the food product sitting directly on the second tray portion when converting the packaging to the second display configuration.

In a further embodiment, removing the first tray portion from the second tray portion also includes tearing, along a tear line extending between the first and second tray portions, the base tray into separated first and second tray portions. When the tear line extends across a bottom wall and two side walls of the base tray, the first and second tray portions are separated along the bottom wall and the two side walls. This separation can open a front end of the base tray in the second display configuration such that the second tray portion provides high visibility and access to the food products stored in the packaging when in the second display configuration. To this end, this embodiment of the method results in an aesthetically desirable and sales-producing display of food product.

In yet another embodiment, the base tray includes only one tear line, and removing the first tray portion from the second tray portion includes producing a smooth front edge along the bottom wall and the two side walls for the second tray portion in the second display configuration. Such a step allows for the packaging to present a uniform front-facing appearance when displayed on the retail store shelf.

The steps and elements described herein can be reconfigured and combined in many different combinations to achieve the desired technical effects.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

With reference to FIGS. 1 through 3B, an embodiment of a shelf-ready packaging 10 ("also referred to as "SRP" 10 herein) is shown in accordance with the present invention. The shelf-ready packaging 10 is configured to be transformed from a first transport configuration to a second display configuration after delivery to a retail store, and typically after placement on a conventional retail store shelf.

It will be appreciated that retail store shelves are space-constrained and typically do not allow for efficient transport containers of food products and other goods to be placed directly on the shelf while still fitting within the space needed. The SRP 10 advantageously varies in length between a larger first length when in the first transport configuration and a smaller second length when in the second display configuration. Accordingly, the SRP 10 of the present embodiments achieves both efficient transport of a large number of food products per container/packaging, and also a desirable display on a retail store shelf that fits within the typical space constraints of such a retail setting. To this end, the SRP 10 enables an improved method for transporting and displaying a food product relative to the retail space.

Figure 1:
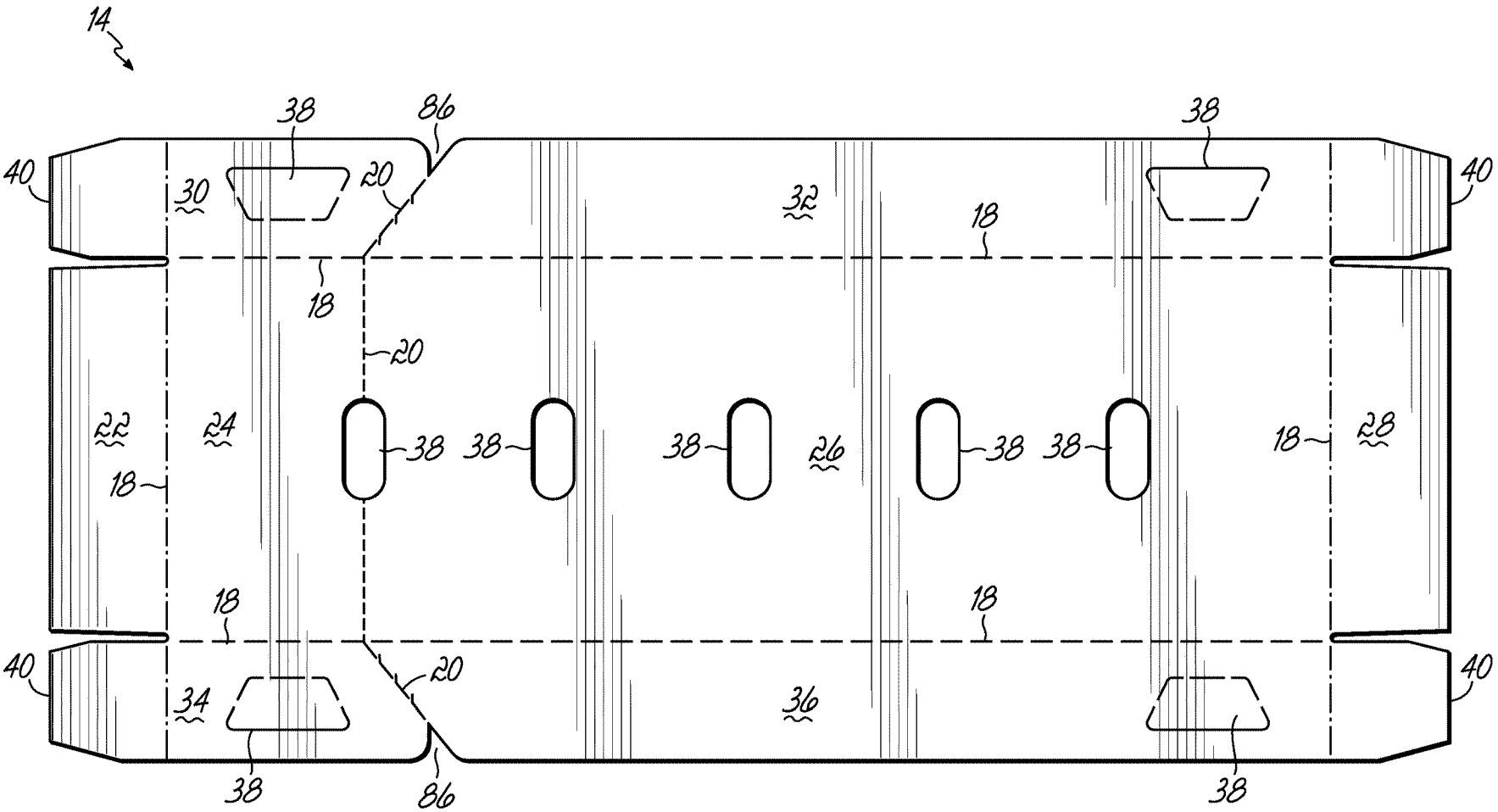
FIG. 1 is a top plan view of a generally planar tray blank having fold lines and a tear line, the tray blank being configured for assembly into a base tray of a shelf-ready packaging, according to one embodiment of the invention.

Now turning with reference to FIG. 1, a tray blank 14 is shown that may be assembled into a base tray 16 as will be shown and described in further detail below. The tray blank 14 is generally planar and is typically formed from a cardboard material, but it will be understood that other packaging materials may be used in other embodiments without departing from the scope of the invention. The tray blank 14 is defined by several panel portions that are connected to one another by linear fold lines 18 and/or by a tear line 20. These panel portions in the present embodiment include: a first end panel 22, a bottom panel first portion 24, a bottom panel second portion 26, a second end panel 28, a first side panel first portion 30, a first side panel second portion 32, a second side panel first portion 34, and a second side panel second portion 36. It will be appreciated that more or fewer panels and portions may be on the tray blank 14 in accordance with the SRP 10 of this invention.

The tear line 20 is a single tear line in this illustrated embodiment, and it extends between the first side panel first portion 30 and the first side panel second portion 32, then between the bottom panel first portion 24 and the bottom panel second portion 26, and finally between the second side panel first portion 34 and the second side panel second portion 36. The fold lines 18 are provided along the junctions between several panel portions, including but not limited to: the junctions between the bottom panel first portion 24 with each of the first side panel first portion 30, the first end panel 22, and the second side panel first portion 34; and the junctions between the bottom panel second portion 26 with each of the first side panel second portion 32, the second end panel 28, and the second side panel second portion 36. The tear line 20 is used when converting the SRP 10 between the first transport configuration and the second display configuration after assembly, while the fold lines 18 are generally used to define different walls out of the panels when assembling the SRP 10 in initial construction of the packaging.

The tray blank 14 and its panel portions are formed with a plurality of vent apertures 38. For example, in FIG. 1 the vent apertures 38 are located along the first side panel second portion 32, the second side panel second portion 36, and the bottom panel first and second portions 24, 26. In this embodiment, the vent apertures 38 located along the bottom panel first and second portions 24, 26 define a generally oblong oval shape in plan view, while the vent apertures 38 located along the first and second side panel second portions 32, 36 define a generally trapezoidal cup shape in plan view, the trapezoidal cup shaped vent apertures 38 being larger in overall opening size than the oblong oval shaped vent apertures 38. More specifically, the oblong oval shaped vent apertures 38 are positioned to be in the bottom of the base tray formed by this tray blank 14, while the trapezoidal cup shaped vent apertures are positioned to be in sidewalls of the base tray formed by this tray blank 14, with the bigger side of the trapezoid oriented upwardly. One of the vent apertures 38 intersects with the tear line 20 as it extends between the junction of the bottom panel first portion 24 and the bottom panel second portion 26. The vent apertures 38 reduce the overall weight and packaging material use for the SRP 10 while also enabling some air ventilation into and out of the storage space defined by the SRP 10 when fully assembled. Of course, the vent apertures 38 may be located in a different number and position than the FIG. 1 illustration, and these vent apertures 38 may be re-shaped from the specific shapes shown without departing from the scope of the invention.

The tray blank 14 is assembled into the base tray 16 in the illustrated embodiment as follows. First, the first end panel 22 and the second end panel 28 are bent upwardly along the corresponding fold lines 18 to be generally perpendicular to the bottom panel first and second portions 24, 26. Next, the first side panel first and second portions 30, 32 are collectively bent upwardly along the fold lines 18 to be generally perpendicular to each of the bottom panel first and second portions 24, 26 as well as the first and second end panels 22, 28. Likewise, the second side panel first and second portions 34, 36 are collectively bent upwardly along the fold lines 18 to be generally perpendicular to each of the bottom panel first and second portions 24, 26 as well as the first and second end panels 22, 28. This creates a general open-box shape with (as of yet) unconnected corners. Next, end tab portions 40 defined as an integral part of each of the first side panel first and second portions 30, 32 and the second side panel first and second portions 34, 36 are bent to form corners adjacent the junctions of the first and second side panels with the first and second end panels 22, 28 and are then connected to an inward-facing side of the first and second end panels 22, 28 such as with adhesive or another connection element. In some embodiments these end tab portions 40 may also be separated from the remainder of the side panel portions by fold lines 18, but such fold lines 18 are not necessary as shown in the illustrated example. It will also be understood that the end tab portions 40 could alternatively be adhered to an outer-facing surface of the first and second end panels 22, 28 in further non-illustrated embodiments of the SRP 10. Following this securing connection of the end tab portions 40 to the first and second end panels 22, 28 (two end tab portions 40 on each end panel 22, 28), the base tray 16 of this embodiment is fully assembled and ready to receive food products. Such a fully assembled base tray 16 is also visible in FIG. 2B for clarity.

FIGS. 2A-2E illustrate the fully assembled shelf-ready packaging 10 and its method of use in further detail, in accordance with one embodiment of the invention. Beginning with FIG. 2A, the SRP 10 is shown in a first transport configuration that is designed for efficiency in delivery of food products 50 contained within the SRP 10 to final sales locations, e.g., retail stores. The SRP 10 is also shown positioned on a retail store shelf 52 in this view to help clarify the purposes of aspects of the design. The SRP 10 includes the base tray 16 and a cover element 54 removably engaged with an upper end of the base tray 16 following assembly of the base tray 16 such as set forth in detail above. The food products 50 are contained within a storage space defined within the box-shaped packaging but are not visible in the configuration shown in FIG. 2A except through the vent apertures 38, several of which are also provided in the cover element 54 (four in the illustrated embodiment). The food products 50 shown in this exemplary embodiment are cups such as dairy product or yogurt cups organized in a plurality of rows within the storage space of the SRP 10, but this is just one example of the types of food products and containers that can be transported and displayed by the SRP 10.

Figure 2A:
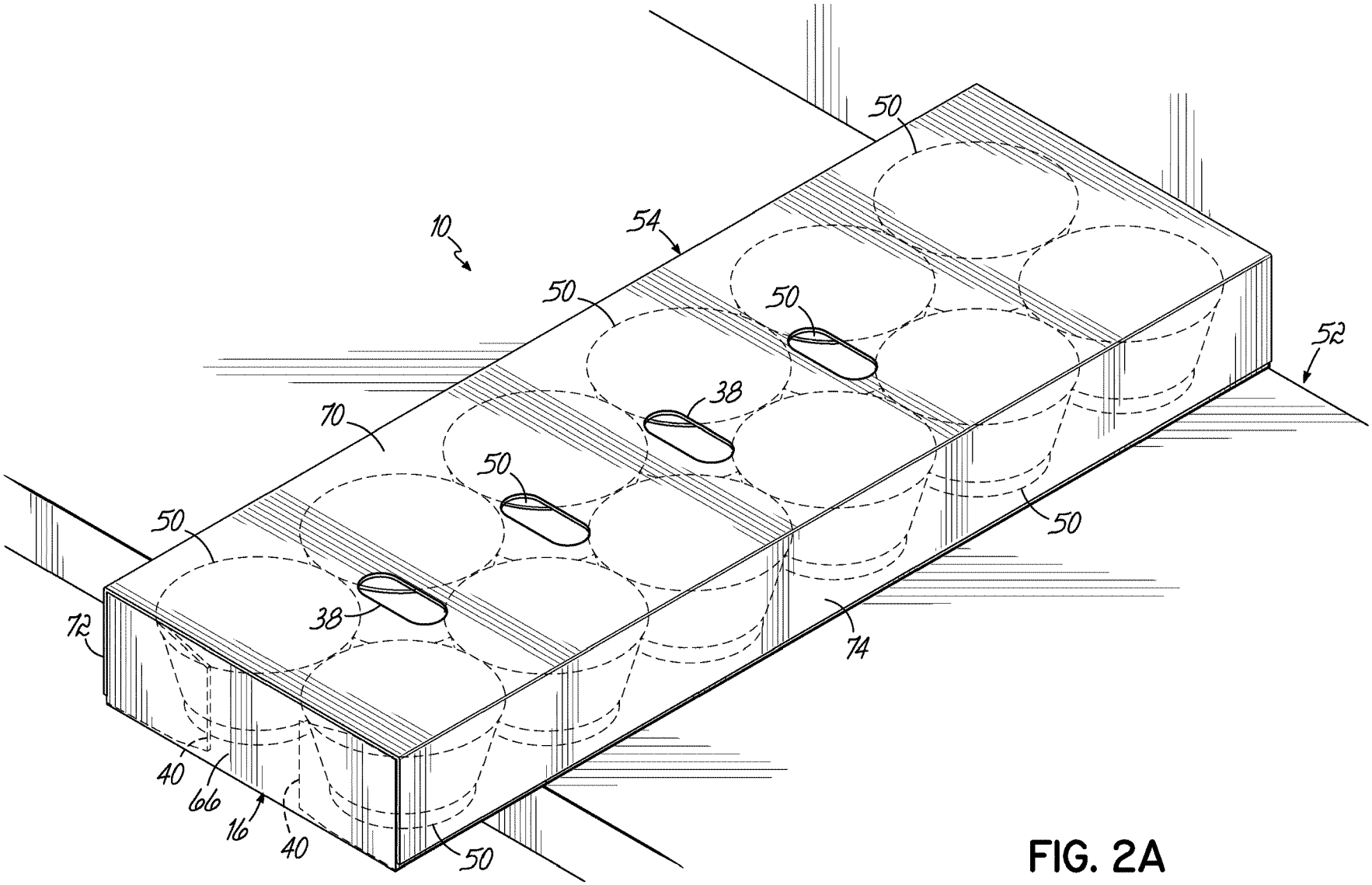
FIG. 2A is a top perspective view of a shelf-ready packaging ("SRP") in accordance with one embodiment, the shelf-ready packaging shown placed upon a standard retail store shelf and in a first transport configuration.
Figure 2B:
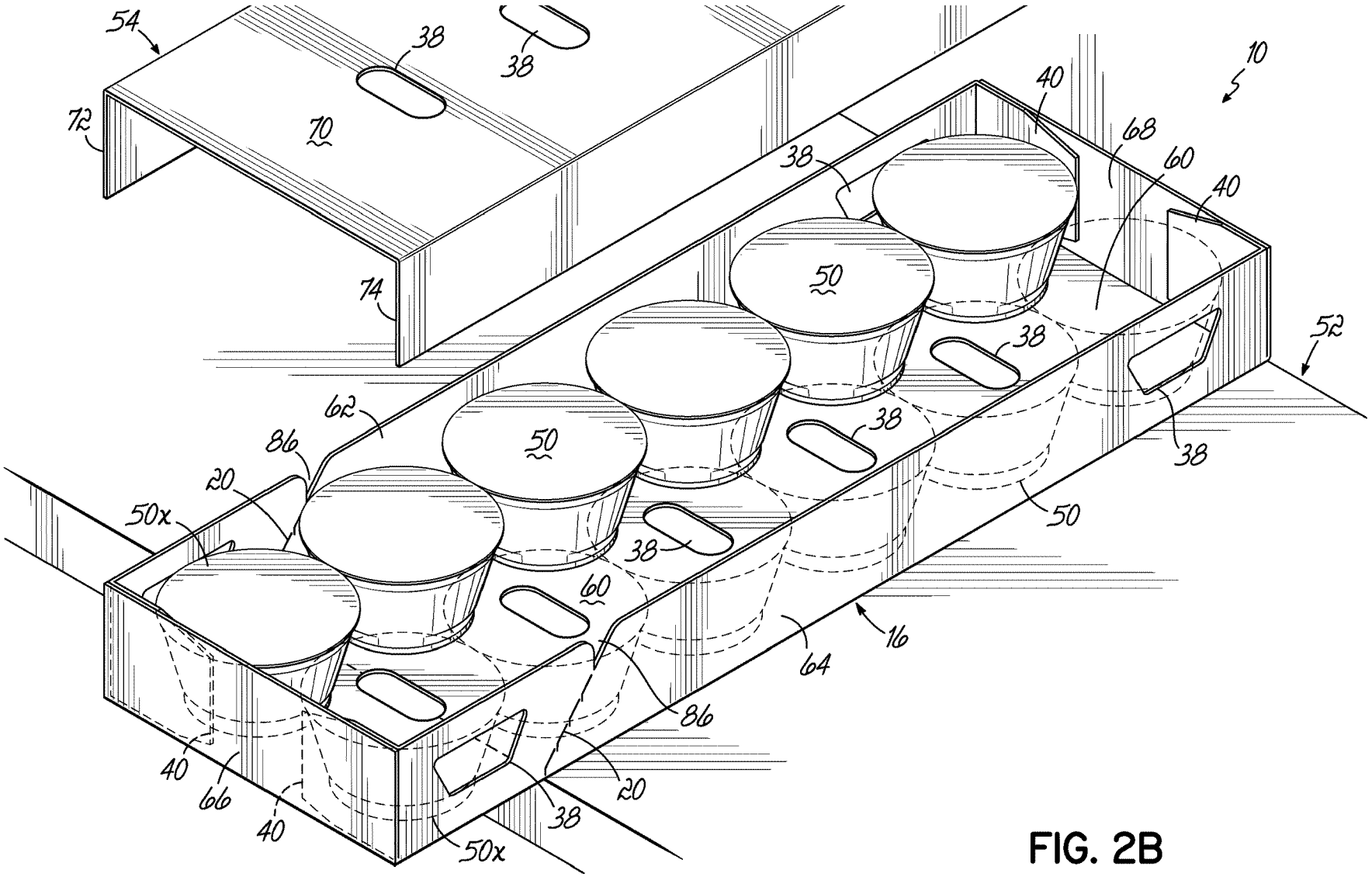
FIG. 2B is a top perspective view of the SRP of FIG. 2A, showing a cover element being removed from a base tray of the SRP.

The base tray 16 in fully assembled form is show in further detail in FIGS. 2A and 2B. To this end, the base tray 16 defines an open-top rectangular box-shaped configuration that defines top and bottom surfaces, opposing side surface, and opposing front and rear end surfaces when positioned on the shelf 52 as shown in these Figures. More specifically, the base tray 16 includes a bottom wall 60, first and second side walls 62, 64 extending upwardly from the bottom wall 60, and front and rear end walls 66, 68 extending upwardly from the bottom wall 60 and between the first and second side walls 62, 64 to enclose the storage space from the bottom and sides. The bottom wall 60 in this embodiment is defined by the bottom panel first and second portions 24, 26 described previously. Likewise, the first side wall 62 is defined by the first side panel first and second portions 30, 32 while the second side wall 64 is defined by the second side panel first and second portions 34, 36. The front end wall 66 is defined by the first end panel 22, previously described, and also potentially the end tab portions 40 adhered to the first end panel 22. The rear end wall 68 is defined by the second end panel 28 and also potentially the end tab portions 40 adhered to the second end panel 28. Other configurations for creating an efficient storage space for transporting the food products 50 will also be possible in other embodiments of the SRP 10, as this is but one example shown in the Figures.

The cover element 54 of this embodiment is shown in further detail in FIGS. 2A and 2B. In this regard, the cover element 54 includes a top wall 70 and opposing longitudinal side walls 72, 74 that extend generally perpendicularly downward from the top wall 70 along opposing edges thereof. In the position shown in FIG. 2A, the top wall 70 engages with the top edges of the base tray 16 (covering the open top thereof), and the longitudinal side walls 72, 74 are positioned adjacent to and alongside the first and second side walls 62, 64. It will be understood that the cover element 54 may be optionally secured in position on the base tray 16 in any known manner, including corresponding retention tabs and slots (not shown) and/or small adhesive bonds provided along the longitudinal side walls 72, 74, and/or other known fastening or securing methods. Four vent apertures 38 are shown as being provided in the top wall 70 in FIG. 2A, but more vent apertures 38 may be included along any of the top wall 70 and the longitudinal side walls 72, 74 in further embodiments of the SRP 10. Furthermore, while the cover element 54 does not include any end wall structures that would be adjacent the front and rear end walls 66, 68, other embodiments may enclose such front and rear end walls 66, 68 to further secure the cover element 54 in position when engaged with the base tray 16.

Further details of the SRP 10 of this embodiment will now be described in accordance with a description of a method of use, which is shown in steps in FIGS. 2A through 2E. As initially described above, the SRP 10 in the first transport configuration is placed on a retail store shelf 52 in FIG. 2A. When in this configuration, the SRP 10 is designed to efficiently transport a plurality of the food products 50 from a site of manufacturing and/or packaging to a site of sale. The SRP 10 defines a rectangular box shape in this configuration, with the cover element 54 engaged with the base tray 16 to secure the food products 50 within the enclosed storage space. Such space-efficient and cost-efficient transport generally necessitates a packaging size which is larger than the area provided for the food products 50 on the store shelf 52. To this end, in FIG. 2A it can be seen that a first length $L_1$ defined by the SRP 10 (as measured between the front and rear ends, more specifically shown later with reference to FIG. 3A) in the first transport configuration is larger than the corresponding length of a conventional store shelf 52. This discrepancy in length and space provided is advantageously addressed when changing the configuration of the SRP 10 of this embodiment.

Once the SRP 10 is transported to the site of final sale/retail, the SRP 10 may be converted from the first transport configuration to a second display configuration. In this regard, the cover element 54 is first lifted from the base tray 16 to disengage these elements from one another. The cover element 54 is shown being lifted from and removed from the remainder of the SRP 10 in FIG. 2B. This reveals the base tray 16, which continues to define a rectangular box shape that is open along a top surface thereof as a result of the cover element 54 being removed, as well as the food products 50 contained therein.

Some of the food products 50 are shown in phantom in FIG. 2B and other views so as to more clearly show features of the SRP 10, but in the illustrated embodiment, these food products 50 are defined by cup-like containers organized into a plurality of rows (e.g., 6 rows with 2 cups per row, in the example shown). As shown in FIG. 2B, the base tray 16 defines a first tray portion 80 and a second tray portion 82 connected to one another by the tear line 20, which extends in this embodiment across each of the bottom wall 60 and the first and second side walls 62, 64. When constructed from the generally planar tray blank 14 described in detail above, the first tray portion 80 is formed from the first end panel 22, the bottom panel first portion 24, the first side panel first portion 30, and the second side panel first portion 34; while the second tray portion 82 is formed from the bottom panel second portion 26, the second end panel 28, the first side panel second portion 32, and the second side panel second portion 36 (these preliminary panel elements not being separated numbered in the FIGS. 2A-2E views). After placement on the store shelf 52, the first tray portion 80 in this embodiment generally extends beyond an end of the store shelf 52, while the second tray portion 82 is sized to fit on the space provided on the store shelf 52. It will be understood that the specific sizes of these portions may be revised in other embodiments to fit different food products 50 or different store shelf configurations.

It can be readily seen in FIG. 2B that at least one of these rows of the food product 50 sits directly upon the first tray portion 80 when the SRP 10 is in the first transport configuration. To continue the conversion into the second display configuration, these row(s) of the food product 50 must be repositioned before further steps can be taken on the SRP 10. To this end, in the example shown in FIGS. 2B and 2C, only a front one row of the food products 50 sits on the first tray portion 80, and this one row is moved to sit on top of one of the other rows of the food products 50 that sits directly upon the second tray portion 82 in a next step of the method. The other rows of the food product 50 sitting on the second tray portion 82 remain stationary and do not require any user action during these steps. Preferably, this one row of the food products 50 is moved on top of the frontmost remaining row of food products 50 such that a larger quantity of the food products 50 is placed near a front end of the second tray portion 82, so as to be in a readily-accessible position for retrieval by consumers when the food products 50 are displayed on the store shelf 52. In embodiments where multiple rows of food product 50 are sitting directly on the first tray portion 80, all of those rows are moved in such a manner before proceeding with further steps of the method. Once the food products 50 are moved in the manner shown in FIG. 2C, the first tray portion 80 is fully emptied and revealed such that it can be removed from the remainder of the base tray 16.

Figure 2C:
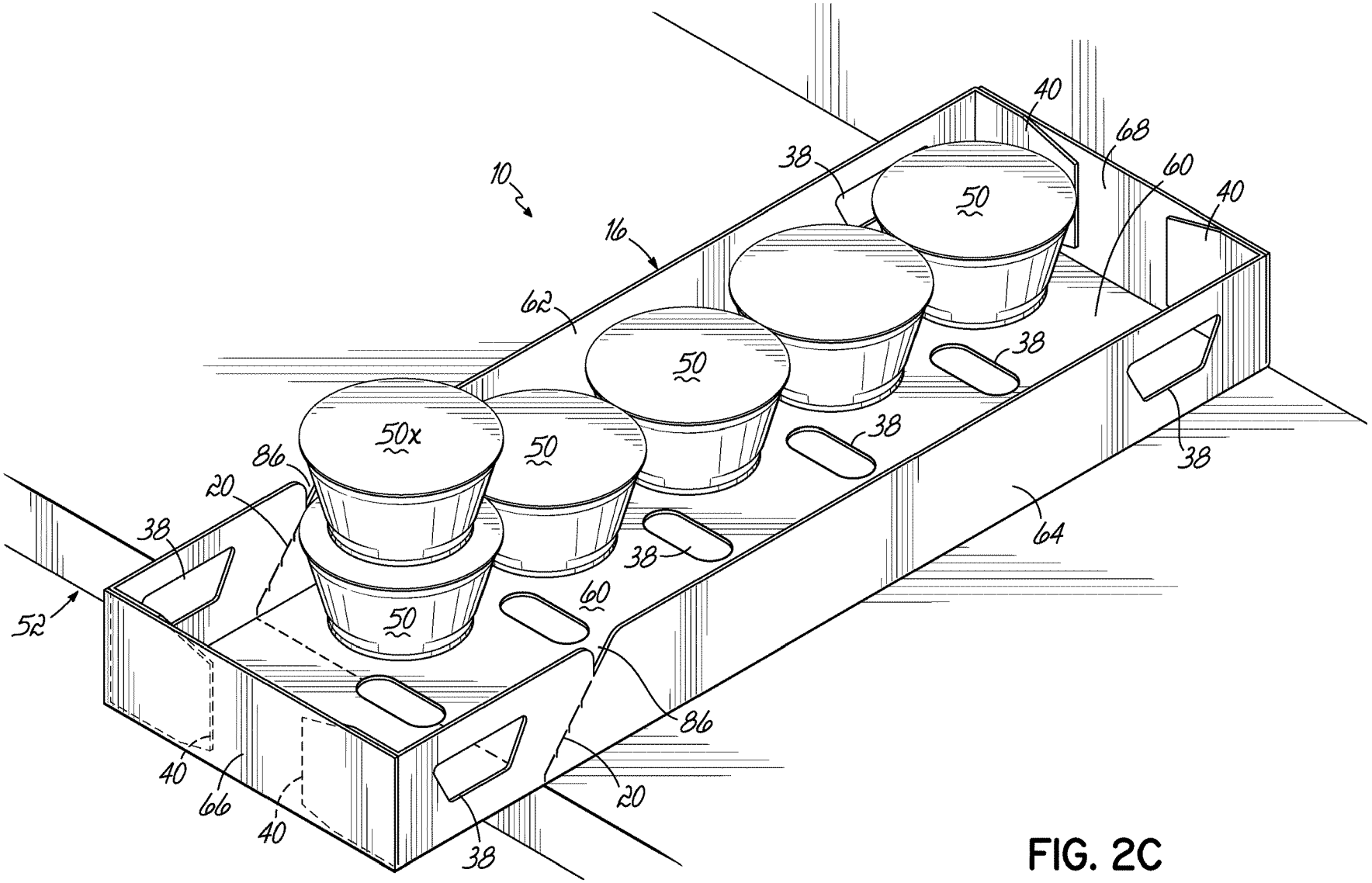
FIG. 2C is a top perspective view of the SRP of FIG. 2B, with one row of the food products moved from sitting directly on top of a first tray portion of the base tray to a position on top of another row of food products.
Figure 2D:
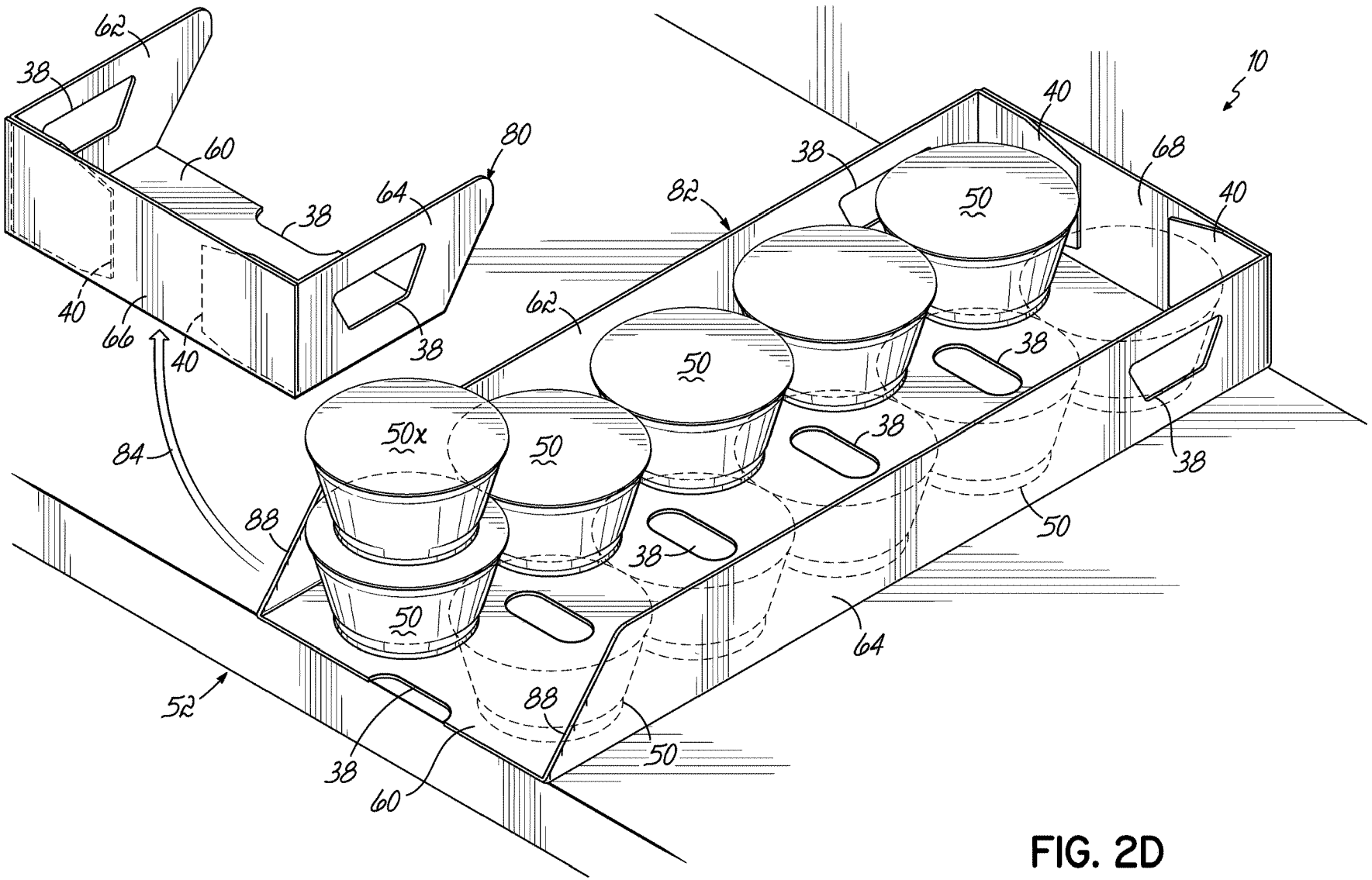
FIG. 2D is a top perspective view of the SRP of FIG. 2C, showing the first tray portion of the base tray being removed from a second tray portion, the latter remaining with the food product on the retail store shelf to define a second display configuration of the SRP.

The first tray portion 80 is then removed from the second tray portion 82 by tearing these elements apart along the tear line 20 extending across the base tray 16. As initially described above, one of the vent apertures 38 may be located along the tear line 20 to reduce the total amount of tearing action that needs to be completed by a user to separate the first and second tray portions 80, 82. With this one tearing action along a single tear line 20 (which is only located along three walls of the base tray 16) in the illustrated embodiment, the base tray 16 is split into the first tray portion 80 and the second tray portion 82, making this step of the reconfiguration of the SRP 10 easy and quick to implement for retail employees. The first tray portion 80 can then be removed from the SRP 10 as shown schematically by arrow 84 in FIG. 2D. The first tray portion 80 and the previously-removed cover element 54 can be discarded or recycled after these removal steps. As shown in FIGS. 2C and 2D, none of the food products 50 need to be moved during this tearing and removal process, which again makes the SRP 10 easy to deploy and set up for the retail setting.

At the point where the tear line 20 intersects with the upper edges of the first and second side walls 62, 64, a cutout 86 may be provided in each of the first and second side walls 62, 64 as most clearly shown in FIG. 2C. The cutout 86 forms a small gap between the first tray portion 80 and the second tray portion 82 at the upper edges of the first and second side walls 62, 64, and in this illustrated embodiment, the cutouts 86 are generally triangular in shape and taper in width between the upper edge and the terminal end of the tear line 20. The cutouts 86 provide a visual indicator to a user where to separate the first and second tray portions 80, 82 from one another, while further reducing the total length of the tear line 20 to further make the separation step quick and easy to perform. The cutouts 86 also allow the portion of the first and second side walls 62, 64 (on the first tray portion 80) that a user grips to begin the tearing action to be large enough to help enable a clean tear from the second tray portion 82, e.g., it is advantageous to not require a user to start a tearing action from a tapered end point on the first and second side walls 62, 64.

FIG. 2D also shows a couple of further aspects included in the tearing action that separates the first and second tray portions 80, 82. The tear line 20 is oriented to be generally parallel to the front and rear end walls 66, 68 along the bottom wall 60, and also oriented to be angled and non-parallel to the front and rear end walls 66, 68 along the first and second side walls 62, 64. More specifically, the angling of the tear line 20 is such that the tear line 20 extends rearwardly as it moves from the bottom wall 60 to the top edges of the first and second side walls 62, 64. Thus, the tear line 20 is closer to the rear end wall 68 of the base tray 16 adjacent the top edges and cutouts 86 as compared to the tear line 20 at the bottom edges of the first and second side walls 62, 64 and at the bottom wall 60. As a result, when the first tray portion 80 is torn and removed from the second tray portion 82, the resulting remainder of the SRP 10 presents an open front end to provide significant visibility and access to any of the food products 50 stored within the SRP 10. This improved visibility and access to the food products 50 is also clear in FIG. 2E, where the conversion of the SRP 10 to the second display configuration is completed.

Figure 2E:
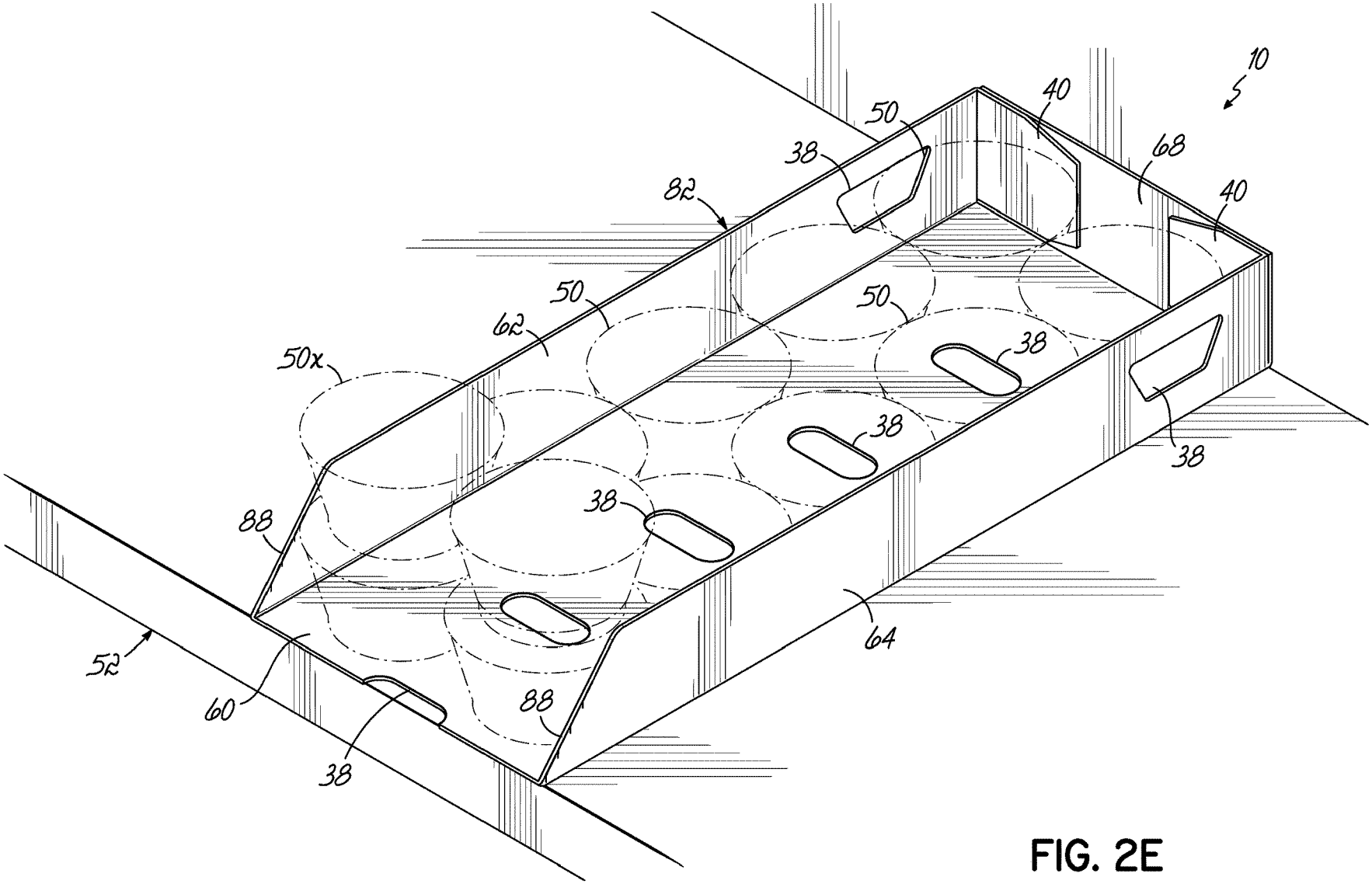
FIG. 2E is a top perspective view of the SRP of FIG. 2D after reconfiguration of the SRP to the second display configuration, with the food products being shown in phantom to reveal additional features of the SRP.

As shown in FIGS. 2D and 2E, the tear line 20 is configured to produce a smooth-edge break during the tearing action to separate the first and second tray portions 80, 82. Consequently, when the SRP 10 is put into the second display configuration, a smooth front edge 88 is created along the first and second side walls 62, 64 and the bottom wall 60 where the tear line 20 was previously located. More specifically, the smooth-edge break in the tearing action is characterized by splitting cleanly so as to leave no gaps, burrs or the like in the material defining the smooth front edge 88. This smooth front edge 88 advantageously presents a uniform front-facing appearance when the SRP 10 is displayed on the store shelf 52 in the second display configuration, which does not distract from the food products 50 being presented for sale to consumers. To this end, the SRP 10 is designed in the second display configuration to enhance the likelihood of sales of the food products 50 contained therein.

As with the cover element 54 and the first tray portion 80, once the food products 50 have been sold off the retail store shelf 52 to empty the SRP 10, the second tray portion 82 may also be discarded or recycled, and the process begun anew with a new SRP 10 loaded with food products 50 and transported to the retail store for the restocking. By allowing for a rapid and easy reconfiguration between the first transport configuration and the second display configuration, the SRP 10 of this embodiment improves the packaging field by making the packaging work better in both the shipping and restocking/retail settings. Thus, cup containers and many other types of food products 50 can be efficiently transported and then displayed for sale to customers using this design.

Figure 3A:
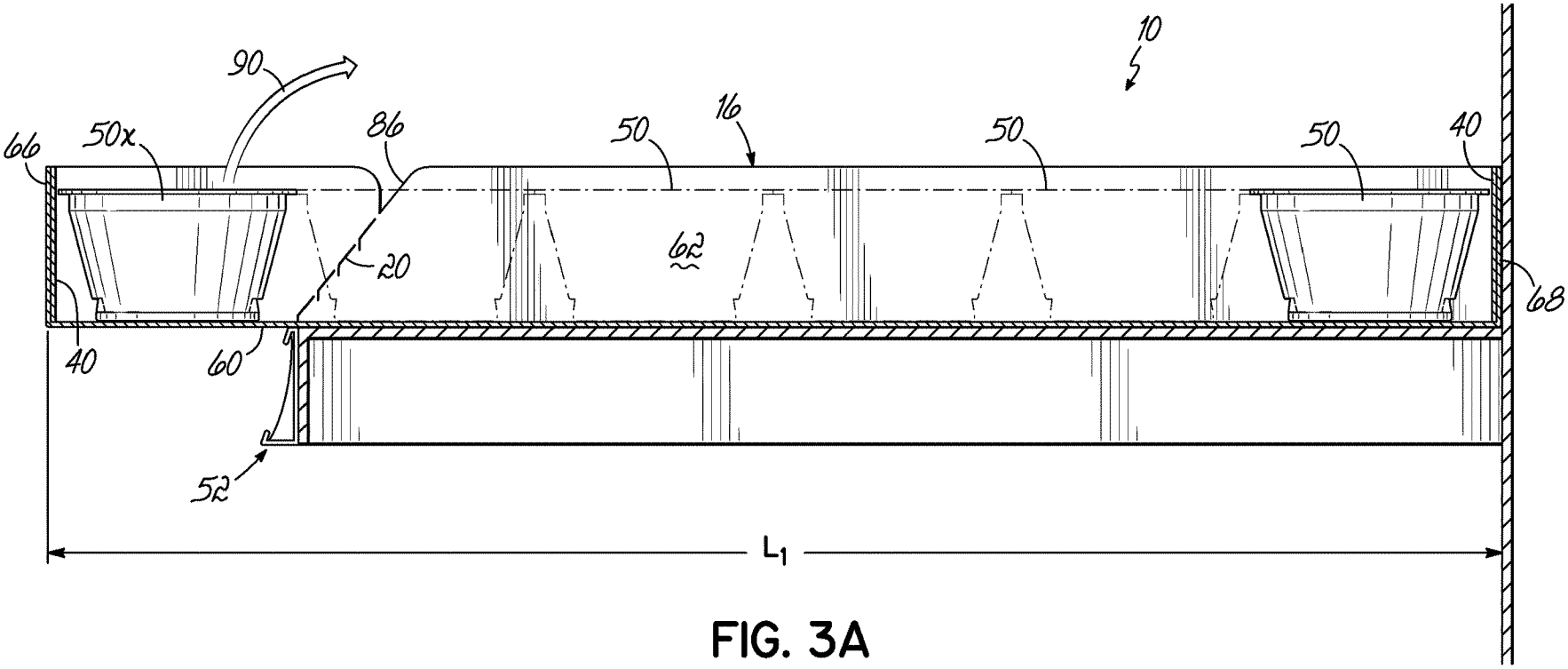
FIG. 3A is a cross-sectional side view of the SRP of FIG. 2C, schematically showing the SRP in initial steps of conversion from the first transport configuration, including moving a row of food product off of the first tray portion.
Figure 3B:
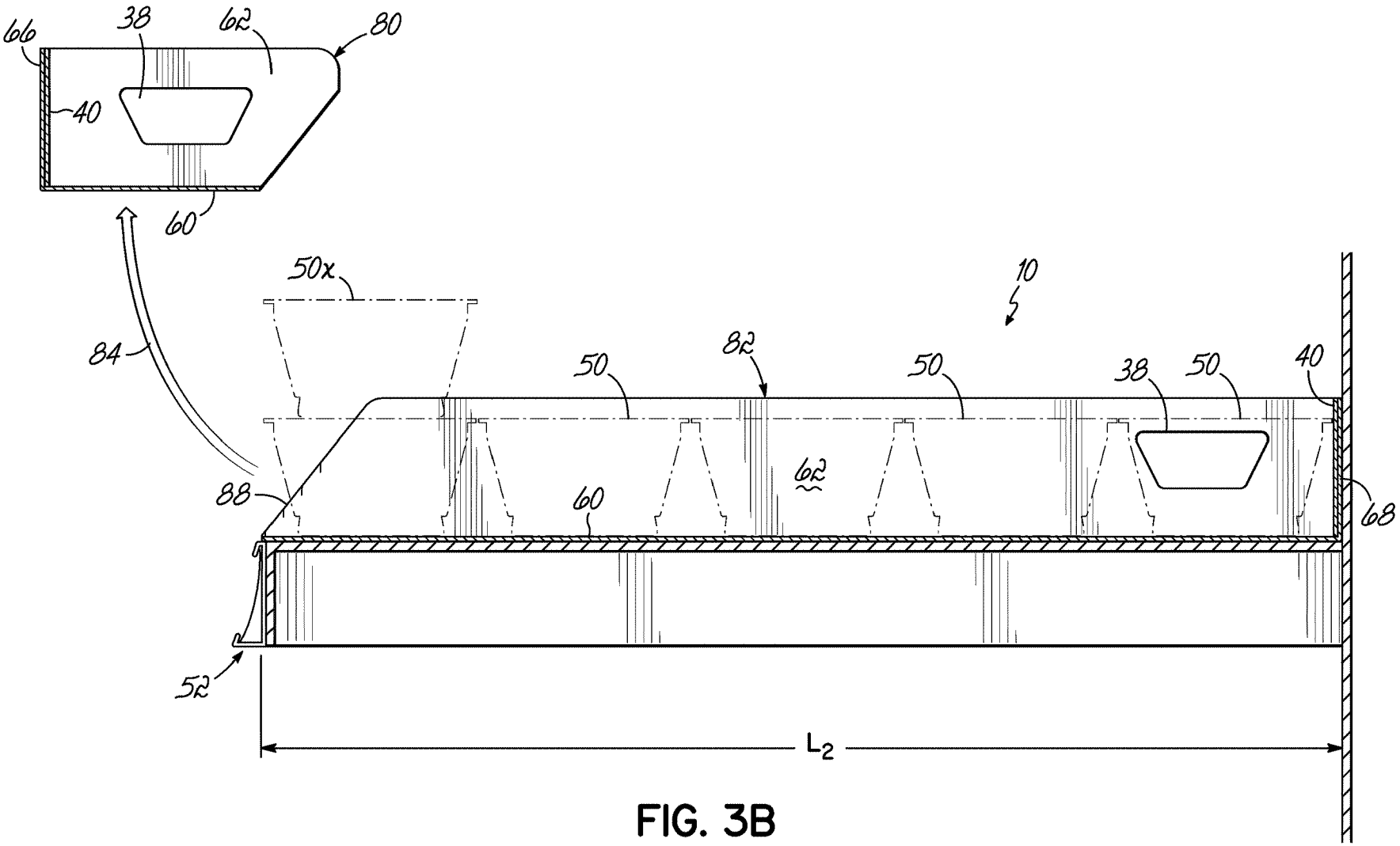
FIG. 3B is a cross-sectional side view of the SRP of FIG. 3A, schematically showing the end steps of conversion to the second display configuration.

This functionality and the technical benefits of the SRP 10 of this embodiment is also further revealed in the side cross sections shown in FIGS. 3A and 3B. FIG. 3A is roughly analogous to the state previously shown and described in FIG. 2B, while FIG. 3B is roughly analogous to the state previously shown and described in FIG. 2D. To this end, the first length $L_1$ of the SRP 10 when the base tray 16 has the first and second tray portions 80, 82 connected together is shown relative to the length of the retail store shelf 52, and this first length $L_1$ is much longer than the store shelf 52. By contrast, when the front rows of food product (indicated specifically by 50*x* in this and other views) are moved off of the first tray portion 80 as shown by arrow 90 in FIG. 3A to the position shown in phantom in FIG. 3B and when the first tray portion 80 is separated and removed from the second tray portion 82 as shown by arrow 84 in FIG. 3B, the second length $L_2$ defined by the remainder of the SRP 10 is a smaller length configured to fit neatly on the store shelf 52. In the illustrated embodiment, $L_2$ is about ⅚ of the total length defined by $L_1$, but in any event, the second length $L_2$ is at least 50% or more of the first length $L_1$. To this end, the majority of rows of the food product 50 (but still only a partial portion of the entire amount of food product 50) are supported on the second tray portion 82 and thus do not necessitate movement when converting the SRP 10 from the first transport configuration to the second display configuration. The variation in length between the two configurations is easy to implement and configures the SRP 10 to operate well in both transport and retail settings.

Thus, the SRP 10 as shown in the illustrated embodiment and other embodiments of this invention improves the packaging field for food products and similar items that are sold on retail store shelves 52. To this end, the SRP 10 provides the normal benefits of being "shelf-ready" because the package can be placed immediately after transport onto a store shelf 52 and then be used to display the food products 50 to consumers in the retail setting. However, unlike conventional SRP designs, the SRP 10 changes length when conducting a simple-to-implement conversion from a first transport configuration to a second display configuration, thereby allowing more space for shipping the goods to the retail store while still fitting properly on a standard store shelf 52 when on display. Furthermore, the tear line 20 of the SRP 10 is configured to make it easy to separate the first and second tray portions 80, 82 from one another while leaving a smooth front edge 88 that creates an open front surface and an open top surface to provide maximum visibility and access to the food products 50 when in the second display configuration. To this end, the visibility and access is similar to that of food products that are completely removed from shipping boxes and individually placed on the retail store shelf 52, which is a much more time and labor-intensive process for retail restock employees.

While the present invention has been illustrated by the description of various preferred embodiments and while these embodiments have been described in some detail, it is not the intention of the Applicant to restrict or in any way limit the scope of the appended claims to such detail. The various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A method for transporting and displaying a food product, comprising:

transporting a shelf-ready packaging containing the food product to a retail store shelf where the food product is to be displayed, the packaging remaining in a first transport configuration during the transporting, the packaging including a base tray with first and second tray portions removably connected to each other and a cover element that covers an open top defined by the base tray in the first transport configuration; and converting the packaging to a second display configuration by:

lifting the cover element from the base tray, and removing the first tray portion from the second tray portion to reveal the food products within the packaging, wherein the packaging defines a first length along a longitudinal axis when in the first transport configuration, and the second tray portion defines a second length along the longitudinal axis when the packaging is in the second display configuration, the second length being less than the first length, wherein the first length is sized such that the packaging stores a plurality of rows of the food product when in the first transport configuration, with at least one of the plurality of rows of the food product sitting directly upon the first tray portion when in the first transport configuration, and the step of converting the packaging to the second display configuration further comprises:

after lifting the cover element from the base tray, moving the at least one of the plurality of rows of the food product to sit on top of other ones of the plurality of rows of the food product, the other ones of the plurality of rows of the food product sitting directly upon the second tray portion and remaining stationary, wherein the first tray portion is removed from the second tray portion after moving the at least one of the plurality of rows of the food product.

2. The method of claim 1, wherein the at least one of the plurality of rows of the food product are moved to sit on top of other rows of the food product located closest to a front end of the packaging to position the food product in a readily-accessible position for retrieval by consumers when the food product is displayed with the packaging in the second display configuration.

3. The method of claim 2, wherein only one of the rows of the food product sits directly on the first tray portion when in the first transport configuration, and this one row of the food product is moved on top of a frontmost row of the food product sitting directly on the second tray portion when converting the packaging to the second display configuration.

4. The method of claim 1, wherein removing the first tray portion from the second tray portion further comprises:

tearing, along a tear line extending between the first and second tray portions, the base tray into separated first and second tray portions.

5. The method of claim 4, wherein the base tray includes a bottom wall, two side walls extending from the bottom wall, and two end walls extending from the bottom wall and between the two side walls, and the step of tearing the base tray into separated first and second tray portions further comprises:

separating the first and second tray portions along the bottom wall and the two side walls, along which the tear line extends.

6. The method of claim 5, wherein the tear line is oriented generally parallel to the two end walls at the bottom wall, and the tear line is angled along each of the two side walls so as to be oriented non-parallel to the two end walls, such that the step of tearing the base tray into separated first and second tray portions further comprises:

opening a front end of the base tray such that the second tray portion provides visibility and access to the food product in the second display configuration.

7. The method of claim 5, wherein the base tray includes only one tear line, the tear line is configured to produce a smooth-edge break between the first and second tray portions, and removing the first tray portion from the second tray portion further comprises:

producing a smooth front edge along the bottom wall and the two side walls for the second tray portion such that the packaging presents a uniform front-facing appearance when displayed in the second display configuration.

* * * * *